US007559955B2

(12) United States Patent
Mente et al.

(10) Patent No.: US 7,559,955 B2
(45) Date of Patent: Jul. 14, 2009

(54) SURFACTANTS USEFUL IN THE REMOVAL OF OILY SOIL FROM FABRIC

(75) Inventors: Glenis R. Mente, Grosse Ile, MI (US); Kenneth L. Zack, Wyandotte, MI (US)

(73) Assignee: BASF Corporation, Florham Park, NJ (US)

( * ) Notice: Subject to any disclaimer, the term of this patent is extended or adjusted under 35 U.S.C. 154(b) by 488 days.

(21) Appl. No.: 11/048,048

(22) Filed: Feb. 2, 2005

(65) Prior Publication Data

US 2005/0170992 A1 Aug. 4, 2005

Related U.S. Application Data

(60) Provisional application No. 60/540,337, filed on Feb. 2, 2004.

(51) Int. Cl.
*B08B 3/04* (2006.01)
*C11D 1/722* (2006.01)

(52) U.S. Cl. ..... 8/137; 510/276; 510/337; 510/360; 510/421; 510/475

(58) Field of Classification Search ..... 510/276, 510/337, 360, 421, 475; 8/137
See application file for complete search history.

(56) References Cited

U.S. PATENT DOCUMENTS 4,212,760 A * 7/1980 Baur et al. ..... 510/339
4,264,457 A * 4/1981 Beeks et al. ..... 510/329

OTHER PUBLICATIONS

International Cosmetic Ingredient Dictionary, Fifth Edition, vol. 1, p. 552, 1993.*

* cited by examiner

*Primary Examiner*—Brian P Mruk
(74) *Attorney, Agent, or Firm*—Howard & Howard Attorneys PLLC

(57) ABSTRACT

Oily soil may be removed from a fabric by washing the oily soiled fabric in a heated (e.g., between about 100° C. to about 200° C. aqueous solution containing a polyethylenepolypropylene diblock surfactant having about 30 to 35 moles of propylene oxide (PO) and about 38 to 50 moles of ethylene oxide (EO).

10 Claims, No Drawings

SURFACTANTS USEFUL IN THE REMOVAL OF OILY SOIL FROM FABRIC

CROSS REFERENCE TO RELATED APPLICATION

This application is based on, and claims domestic priority benefits under 35 U.S.C. §119(e) from, U.S. Provisional Application No. 60/540,337, filed Feb. 2, 2004, the entire content of which is hereby incorporated by reference.

This invention relates to surfactants useful in the removal of oily soil from fabric. More particularly, this invention relates to the use of specific polyethylene/polypropylene diblock surfactants to remove oily soil from cotton fabric.

Removal of oily soils from fabric is important in the textile industry in the preparation of fabrics prior to dying. Natural waxes and oils, as well as those oils and other additives used in the production of the fabric can interfere with the even dying of cloth. Oily soil removal is also an important function of detergents used for laundering clothing. Surfactants having oily soil removal properties greater than about 70% would be useful in these applications.

Anionic and nonionic surfactants have been used in laundry compositions to increase the efficacy of the detergent in removing oily soil. Nonionic surfactants such as the commercially available alcohol ethoxylates have been used in this type of application. Likewise, anionic surfactants such as the linear or branched alkylbenzene sulfonates are commonly used in detergent compositions as soil removers.

However, despite extensive research activity in this field there remains a need for additional surfactants which have superior soil release properties, especially oil and grease borne soil, and which is highly effective on all fabrics but especially on fabrics such as cotton and cotton blends.

It has now been found that the use of a polyethylene/polypropylene diblock surfactant having preferred amounts of PO and EO enhances oily soil removal when compared to the cleaning performance of triblock surfactants of similar composition and of diblock surfactants having different amounts of EO/PO.

The present invention provides a method for the removal of oil soil from fabric which comprises washing the soiled fabric in an aqueous solution containing a polyethylene/polypropylene diblock surfactant having about 30 to 44 moles of PO and about 38 to 55 moles of EO).

The fabric to be cleaned can be any fabric that can be cleaned in an aqueous medium at a temperature above room temperature. Preferred fabrics include cotton and cotton blends, more preferably cotton.

The washing is carried out at a temperature of from about 100° C. to about 200° C., preferably from about 125° C. to about 180° C., more preferably from about 150° C. to about 160° C.

The di-block surfactants of the instant invention are composed of propylene oxide (PO) and ethylene oxide (EO). They are prepared by reacting PO onto methanol to which a block of EO is then reacted by methods known in the art. Various levels of EO and PO are contained in the di-block surfactants. The preferred levels of the instant invention comprise about 30 to 44 moles, preferably about 30 to 35 moles, and more preferably about 32 moles of PO and 38 to 55, preferably 38 to 50 moles, and more preferably about 40 moles of EO. Especially preferred EO/PO di-block surfactants of the invention include a di-block surfactant having 32 moles of PO and 55 moles of EO, a di-block surfactant having 44 moles of PO and 55 moles of EO and a di-block surfactant having 32.

The present invention is further illustrated by the following non-limiting Examples, wherein all parts and percentages are on a weight basis unless otherwise indicated.

EXAMPLE 1

Preparation of Di-block Polymer

To a suitable stainless steel reaction vessel was placed 7794 grams of a 1700 molecular weight monomethylpolyoxypropylene ether and 40.7 grams of potassium hydroxide. The mixture was heated to 105° C. under vacuum for one hour to remove volatiles. The vacuum was relieved with nitrogen and the temperature was increased to 140° C. 10145 grams of ethylene oxide was added and the mixture was allowed to react for one hour. The reaction mixture was cooled to 80° C. and neutralized with phosphoric acid to yield a waxy solid.

EXAMPLE 2

Testing was carried out using the following test method.

Five bleached and desized cotton swatches (#400) having sewn edges to prevent fraying were used for each surfactant tested.

The swatches were weighed together then each was soiled with 12 drops each of SAE 80W-90 gear oil, SAE 30 motor oil and light mineral oil. The soiled swatches were wrapped in foil and pressed together overnight at 5000 lbs with a Carver press to distribute the oils evenly, and then reweighed. A 300 ml aqueous solution of the surfactant (500 ppm) was heated to about 155° C. and the soiled cloths were washed in the test solution for 15 minutes. The swatches were then rinsed in cold water, spread out to air dry overnight and then weighed. The percent of soil removed was calculated from the observed weights. The results are set forth in the table below.

The first number in the surfactant designation represents the number of moles of propylene oxide and the second number is the number of moles of ethylene oxide.

| Example No. | Sample | % Soil Removed |
|---|---|---|
| 1 | Diblock 32/55 | 70 |
| 2 | Diblock 44/55 | 70 |
| 3 | Diblock 8/10 | 43 |
| 4 | Diblock 20/25 | 43 |
| 5 | Diblock 32/10 | 65 |
| 6 | Diblock 8/40 | 45 |
| 7 | Diblock 20/40 | 45 |
| 8 | Diblock 20/55 | 42 |
| 9 | Diblock 32/40 | 81 |
| 10 | Diblock 32/40 repeat | 82 |
| 11 | Diblock 44/40 | 59 |
| 12 | Diblock 32/25 | 71 |
| 13 | Diblock blend | 71 |
| 14 | Pluronic ® P65 surfactant (19EO/30PO/19EO) | 77 |
| 15 | Pluronic ® P75 surfactant (24EO/35PO/24EO) | 78 |
| 16 | Pluronic ® P77 surfactant (52EO/35PO/52EO) | 67 |

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

The invention claimed is:

1. A method for the removal of oily soil from fabric which comprises washing a fabric soiled with oil in a heated aqueous solution containing a polyethylenepolypropylene diblock surfactant for a time sufficient to remove at least 70% of the oil from the fabric, wherein the diblock surfactant is at least one having propylene oxide (PO) and ethylene oxide (EO) units selected from the group consisting of a diblock surfactant having 32 moles of PO and 55 moles of EO, a diblock surfactant having 44 moles of PO and 55 moles of EO and a diblock surfactant having 32 moles of PO and 40 moles of EO.

2. The method of claim 1 wherein the fabric is cotton.

3. The method of claim 1 wherein the fabric is washed at a temperature of from about 100° C. to about 200° C.

4. The method of claim 3 wherein the temperature is from about 125° C. to about 180° C.

5. The method of claim 4 wherein the temperature is from about 150° C. to about 160° C.

6. The method of claim 1 wherein at least 80% of the soil is removed.

7. A surfactant for the removal of oily soil from fabric comprising a polyethylenepolypropylene diblock surfactant having propylene oxide (PO) and ethylene oxide (EO) units which is at least one selected from the group consisting of a diblock surfactant having 32 moles of PO and 55 moles of EO a diblock surfactant having 44 moles of PO and 55 moles of EO and a diblock surfactant having 32 moles of PO and 40 moles of EO.

8. An aqueous fabric cleaning solution comprised of an oily soil removing effective amount of a surfactant as in claim 7.

9. An aqueous fabric cleaning solution as in claim 8, wherein the surfactant is present in an amount sufficient to remove at least about 70% of the oily soil in the fabric when the fabric is washed at a temperature of from about 100° C. to about 200° C.

10. The aqueous solution as in claim 9, wherein the surfactant is present in an amount sufficient to remove at least about 80% of the oily soil in the fabric.

* * * * *